US005683844A

United States Patent [19]

Mammino

[11] Patent Number: 5,683,844

[45] Date of Patent: Nov. 4, 1997

[54] FIBRILLATED CARRIER COMPOSITIONS AND PROCESSES FOR MAKING AND USING

[75] Inventor: Joseph Mammino, Penfield, N.Y.

[73] Assignee: Xerox Corporation, Stamford, Conn.

[21] Appl. No.: 535,602

[22] Filed: Sep. 28, 1995

[51] Int. Cl.[6] ..... G03G 9/113

[52] U.S. Cl. ..... 430/106.6; 430/108; 430/111; 430/137; 428/406; 428/407; 427/213; 427/221; 427/222; 427/346

[58] Field of Search ..... 430/108, 106.6, 430/137, 111; 428/406, 407; 427/346, 221, 222, 213

[56] References Cited

U.S. PATENT DOCUMENTS

| | | | |
|---|---|---|---|
| 3,838,064 | 9/1974 | Vogt et al. | 252/384 |
| 3,838,092 | 9/1974 | Vogt et al. | 260/33.6 |
| 3,986,851 | 10/1976 | Grodek | 55/488 |
| 4,148,640 | 4/1979 | Dulmage et al. | 430/111 |
| 4,457,994 | 7/1984 | Pai et al. | 430/59 |
| 4,526,851 | 7/1985 | Boughton et al. | 430/106.6 |

FOREIGN PATENT DOCUMENTS

| | | | |
|---|---|---|---|
| 60-46567 | 3/1985 | Japan | 430/108 |
| 2-1880 | 1/1990 | Japan | 430/108 |

OTHER PUBLICATIONS

Brickell, C, ed *The American Horticultural Society Encyclopedia of Gardening* (1993) Dorung Kindersley, London p. 402.

Patent & Trademark Office English–Language Translation of JP 60–46567 (Pub Mar. 1985).

Patent & Trademark Office English–Language Translation of JP 2–1880 (Pub Jan. 1990).

*Webster's New World Dictionary*, Third College Edition, (1988), p. 1379.

*Primary Examiner*—Janis L. Dote

*Attorney, Agent, or Firm*—John L. Haack

[57] ABSTRACT

A carrier comprised of a core with a coating thereover comprised of at least one polymer resin and wherein the outer surface of the coated carrier is fibrillated.

24 Claims, No Drawings

FIBRILLATED CARRIER COMPOSITIONS AND PROCESSES FOR MAKING AND USING

CROSS REFERENCE TO COPENDING APPLICATIONS AND RELATED PATENTS

Reference is made to commonly assigned copending applications: U.S. Ser. No. 08/535,852 pending (D/93403) filed not yet assigned concurrently herewith, to sole named inventor Deepak Maniar, entitled "Conductive Carrier Compositions and Processes for Making and Using".

Attention is directed to commonly owned and assigned U.S. Pat. Nos.: 4,937,166, issued Jun. 26, 1990, entitled "Polymer Coated Carrier Particles for Electrophotographic Developers", which discloses a carrier composition comprised of a core with a coating thereover comprised of a mixture of first and second polymers that are not in close proximity thereto in the triboelectric series; 5,220,481, issued Jun. 15, 1993, to Swift et al., entitled "Composite to Enable Contact Electrostatic Voltage Sensing", discloses a method of preparing fibrillated composite fibers for use electrostatic voltage sensing applications; and 5,424,160, issued Jun. 13, 1995, to Smith et al., entitled "Conductive Carrier Coatings and Processes for the Preparation Thereof", discloses a coated carrier wherein the coating is comprised of a conductive polymeric dopant in a fluoropolymer host resin.

The disclosures of each of the aforementioned documents are totally incorporated herein by reference.

BACKGROUND OF THE INVENTION

This invention is generally directed to developer compositions, and more specifically, the present invention relates to carrier compositions comprised of a core with a polymer resin coating thereover wherein the outer surface of the carrier coating is fibrillated, and processes for the preparation thereof. The highly fibrillated outer surface structure of the resin coated carrier particles are prepared, in embodiments, for example, using high shear surface abrasion treatment of, for example, known resin coated carrier compositions obtained by, for example, dry powder or solution coating processes. In other embodiments, the fibrillated outer surface of the carrier particles can be achieved by adding micron or submicron fibrous materials to the resin material used to coat the carrier particles. Alternatively, the fibrous materials can be applied directly to the surface of the resin coated carrier particles.

In embodiments of the present invention, the carrier particles are comprised of a core with coating thereover generated from one or more polymers that are not in close proximity in the triboelectric series. Moreover, in another aspect of the present invention, the carrier particles are prepared with one or more polymers applied to the carrier core particle surface enabling insulating particles with relatively constant conductivity parameters; and wherein the triboelectric charge on the carrier can be selected depending on the coatings chosen and the extent of the carrier surface fibrillation. Developer compositions comprised of the surface fibrillated, resin coated, carrier particles of the present invention are useful in electrostatographic or electrophotographic imaging systems, especially xerographic imaging processes. Additionally, developer compositions comprised of substantially insulating carrier particles prepared in accordance with the processes of the present invention are useful in imaging methods wherein relatively constant conductivity parameters are desired. Furthermore, in the aforementioned imaging processes, the triboelectric charge on the carrier particles can be preselected depending on the polymer composition, and the amount thereof, applied to the. carrier core, and the amount of carrier particle surface fibrillation.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, as it is these values that enable continued constant developed images of high quality and excellent resolution.

Additionally, carrier particles for use in the development of electrostatic latent images are described in many patents including, for example U.S. Pat. No. 3,590,000. These carrier particles may consist of various cores, including steel, with a coating thereover of, for example, fluoropolymers, and terpolymers of styrene, methacrylate, and silane compounds. Recent effort in the field has focused on the attainment of coatings for carrier particles, for the purpose of improving development quality; and to permit particles that can be recycled, and that do not adversely effect the imaging member in any substantial manner. Many present commercial carrier coatings can deteriorate rapidly, especially when selected for a continuous xerographic process where the entire coating may fail upon impact, or abrasive contact with machine parts and other carrier particles. Another problem encountered with some prior art carrier coatings resides in fluctuating triboelectric charging characteristics, particularly with changes in relative humidity. The fluctuating triboelectric charging characteristics provides developed images of lower quality, and with background deposits.

There is also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of the '387 patent, are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover the triboelectric values can be selected to vary significantly as desired, for example, from less than −15 microcoulombs per gram to greater than −70 microcoulombs per gram, depending on the polymer mixture selected for affecting the coating process and the extent to which the resin coated surfaces of the carrier particles are fibrillated.

With further reference to the prior art, carriers obtained by applying insulating resinous coatings to porous metallic carrier cores using solution coating techniques are well known.

Other patents of interest include U.S. Pat. Nos. 3,939,086 , which teaches steel carrier beads with polyethylene coatings, see column 6; 4,264,697, which discloses dry coating and fusing processes; 3,533,835; 3,658,500; 3,798,167; 3,918,968; 3,922,382; 4,238,558; 4,310,611; 4,397,935; 4,434,220 and 4,937,166.

The fibrillated coated carriers and coating and surface modification processes of the present invention overcome several disadvantages as illustrated herein, and further enable developer mixtures that are capable of generating high and useful triboelectric charging values with finely divided toner particles; and providing carrier particles that possess substantially constant conductivity. Further, when resin coated carrier particles are surface modified to produce fibrillated carrier particles by the processes of the present invention, there are provided developer compositions which possess the following properties: reduced toner dusting during latent image development using fine particle toners, for example, diameters less than about 7 to 8 microns; enhanced developer lifetimes or longevity due to an increased tribocharging surface area of the carrier particles; reduced impaction of toner particles on the carrier particles; and increased toner holding capacity of the developer enabling high toner concentration gradient tolerant developers.

Additionally, there can be independently achieved, using the preparative and imaging processes of the present invention, desirable triboelectric charging characteristics and conductivity values. For example the triboelectric charging parameter is not dependent on the carrier coating weight as is believed to be the situation with the process disclosed in U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values using a number of different formulation and process variable combinations.

Thus, for example, there can be formulated in accordance with the invention of the present invention developers with conductivities of from about $10^{-6}$ mho $(cm)^{-1}$ to $10^{-17}$ mho $(cm)^{-1}$ as determined in a magnetic brush conducting cell; and positive or negative triboelectric charging values of from about 5 to about 80 microcoulombs per gram on the fibrillated coated carrier particles as determined by the known Faraday cage technique. Thus, the developers of the present invention can be formulated with constant conductivity values with different triboelectric charging characteristics by, for example, maintaining the same coating weight on the carrier particles and changing the ratio of polymer resins used to form the coating. Similarly, there can be formulated developer compositions wherein constant triboelectric charging values are achieved and the conductivities are altered by retaining the polymer coating ratio constant and changing the relative polymer coating weight for the carrier particles.

There exists a need for highly robust developer compositions for use in high speed—high print per minute imaging operations and under drastically changing environmental conditions, for example, temperature and humidity.

There also remains a need for coated carrier compositions with highly fibrillated outer surfaces and which carriers are capable of providing developers with desirable development and imaging characteristic.

Still further, there is a need for processes for the preparation of coated carrier compositions wherein the outer surface of the polymer resin coating is highly fibrous or fibrillated and possesses and imparts desirable properties to the developer as illustrated herein.

Solutions to the above problems and needs have been unexpectedly found in the fibrillated carrier compositions and processes of making and using of the present invention. The carrier compositions provide superior developer compositions that enable improved developer and carrier longevity, and controlled conductivity and triboelectric charge levels compared to those known in the art.

SUMMARY OF THE INVENTION

It is an object of the present invention to provide toner and developer compositions with carrier particles containing a polymer or polymer mixture coating wherein the outer surface of the carrier coating is fibrillated.

In another object of the present invention there are provided surface coating treatment processes for generating fibrillated carrier particles and which particles have selectable and substantially constant conductivity parameters.

In yet another object of the present invention there are provided processes for preparing surface fibrillated coated carrier particles with substantially constant conductivity parameters, and a wide range of preselected triboelectric charging values.

In yet a further object of the present invention there are provided surface fibrillated coated carrier particles comprised of a core, and a coating with a mixture of polymers that are not in close proximity, that is for example, a mixture of polymers from different positions in the triboelectric series.

In still yet another object of the present invention there are provided surface fibrillated coated carrier particles comprised of a core, a thermoplastic resin surface coating, and fibrous particulate material embedded in and protruding for the resin surface coating.

Another object of the present invention provides fibrillated coated carrier compositions comprised of a core, a polymer resin surface coating, and an optional plasticizer compound, wherein the plasticizer resides in the resin coating and does not readily migrate therefrom.

Other objects of the present invention include providing: a method and means for controlling toner dusting in xerographic development processes employing small sized toner particles; a method of suppressing xerographic machine dirt and uncontrolled toner powder clouding, especially with small sized color toner particles; increased tribo charging sites on the carrier surface; improved developer charge control properties; and improved developer lifetime or longevity.

These and other objects are achieved, in embodiments, of the present invention as described and illustrated herein.

DETAILED DESCRIPTION OF THE INVENTION

Resin coated carrier compositions can be prepared in embodiments of the present invention which have a highly fibrous or fibrillated surface texture and structure. The fibrillated coated carriers of the present invention have numerous advantages and improvements over relatively smooth surface coated carrier compositions known in the art.

In embodiments of the present invention, there are provided carrier composition comprised of a core with a coating thereover comprised of at least one polymer resin such as 1 to about 5 resins, and preferably 1 to 2 resins, and wherein the outer surface of the polymer resin coating is fibrillated.

In embodiments of the present invention, there are provided developer compositions comprised toner particles, and carrier particles comprised of a core with a coating thereover comprised of at least one polymer resin and wherein the outer surface of the polymer resin coating is fibrillated.

In embodiments of the present invention, there are provided fibrillated coated carrier particle compositions and which coated particles have a considerably higher total surface area compared to the uncoated carrier particles and to coated nonfibrillated carrier particles.

In embodiments of the present invention, there are provided fibrillated coated carrier compositions wherein the polymer resin coating contains other performance additives, for example, charge control additives, plasticizer compounds, fibrous particulate materials, and mixtures thereof.

In embodiments of the present invention, there are provided processes for preparing fibrillated coated carrier compositions comprising: providing a polymer resin coated carrier composition; and agitating the polymer resin coated carrier particles with highly abrading shear force wherein the resulting outer surface of the polymer coating is highly fibrous or fibrillated. In other embodiments, the fibrillated coated carriers can be prepared by the inclusion of fibrous particulate materials in the polymer resin or resins used in dry powder or solution coating processes. In still other embodiments, the fibrillated coated carriers can be prepared by the inclusion of a plasticizer compound along with a resin and solvent coating mixture. In aspects of the solution coating preparative process of placing the polymer resin onto the surface of the carrier, in a preferred embodiment, the agitation of the resulting polymer coated carrier particles to form the fibrillated resin surface, is conducted simultaneously with the evaporation of the solvent.

In embodiments of the present invention, there are provided processes for directly preparing fibrillated coated carrier compositions comprising coating carrier core particles with a mixture of at least one polymer resin, and fibrous particulate additive, and optionally a plasticizer compound, wherein the resulting outer surface of the coated carrier is fibrillated as a result of the fibrous particulate additive residing on or near the surface of the coated core particles. Thus, fibrillated coated carrier compositions of the present invention can be, in embodiments, obtained without the aforementioned agitation step when an appropriate fibrous particulate additive is selected, for example, a fibrillated polymer, such as fibrillated KEVLAR an aramid fiber available from DuPont. The fibrillated coated carrier particles optionally may be subsequently agitated with high shear to further fibrillate the coated surface and/or to modify the tribocharge or conductivity properties of the carrier particles.

The term "fiber" refers, for example, to any particles which exhibit geometries and appearance characteristics which provide fibrils, tendrils, tentacles, threadlets, ligaments, hairs, bristles, whiskers, or the like structures.

The term "fibril" refers, for example, to a small, slender fibrous particle, with an average diameter of about 0.01 microns to about 25 microns, and an average length of about 1 micron to about 3,125 microns.

The term "fibrillation" refers, for example, to the forming of fibers or fibrils.

The term "fibrillated" refers, for example, generally to any surface having a fiber or fibers thereon. Thus, a surface such as a coated carrier particle having a coating thereover and upon suitable abrasive treatment as illustrated herein, produces a fibrillated or fibrous carrier surface. In other embodiments, of the present invention, there can be included in the thermoplastic resin overcoating a fibrillated fiber material, that is, a fibrous particulate material having still other fibers, typically smaller fibers, extending from the surface of individual fibers.

Fibrillated and non-fibrillated fibers and resin materials are known in the art, reference for example, U.S. Pat. Nos. 5,405,923 which discloses suspension polymerization processes for preparing non-fibrillatable polytetrafluoroethylene particles which are irregular, fibrous. and coarse; 4,883,716 which discloses the known tendency of dispersion derived polytetrafluoroethylene to fibrillate upon intimate particle contact; 4,729,921 and 4,698,267 which disclose characterization and control of fibrillation in aramid fibers; and 4,410,586 which discloses reinforcing polymer matrices with fibers, to form films and fibrillated films.

U.S. Pat. Nos. 3,838,064 and 3,838,092 to Vogt et al., and 3,986,851 to Grodek are of interest in that they disclose, respectively, a process for dust control, a dustless fibrous polytetraflourocthylene (PTFE) composition, and a filter article comprised of fibrillatable PTFE fibers.

The disclosures of the above patents are incorporated herein by reference in there entirety.

Although not wanting to be limited by theory it is believed that the aforementioned fibrils or fibers on the surface of the carrier particles of the present invention impart unexpected and unique properties to the carrier particles and to developers formulated therefrom. Thus, the fibrilled carrier compositions of the present invention are further differentiated from known compositions in that compositions of the present invention exhibit, for example, increased tribocharging surface area, reduced net impaction by toner particles, increased toner holding capacity, and reduced toner powder clouding.

The fibrillated outer surface of the resin coated carrier has a relatively large BET surface area of about 25 square centimeters per gram to about 1,500 square centimeters per gram and a relatively large fiber surface area coverage, for example in embodiments, of about 1 fiber per 10 square microns to about 9,000 fibers per 10 square microns.

The polymeric fibrils obtained by direct shear stress abrasion of the coated carrier surface with mechanical means have dimensions with an average diameter of about 0.01 microns to about 25 microns, and an average length of about 1 micron to about 3,125 microns.

Fibrils can also be further introduced to the surface of the resin coated carrier particles by incorporating the fibrils into the resin surface coating mixture or applying the fibrils to the coated carrier surface. Fibrous particulate materials useful in the present invention include, for example, fibrillated polytetrafluoroethylene, fibrillated aramid or polyaramid, polymers and copolymers of alkene monomers with from 2 to about 20 carbon atoms, such as polyethylene and polypropylene, carbon, cellulose, quaternized cellulose, acidified cellulose, microcrystalline cellulose cotton, clay, glass, fibrillated minerals such as fibrillated quartz, and the like, and mixtures thereof. Fibrous particulate materials of the present invention includes, but is not limited to, metallized synthetic fibers, metal fibers, metal flakes, metal whiskers, and mixtures thereof. The fibrous particulate material additive when selected is present in an amount of from about 0.5 to about 75 weight percent based on the total weight of the polymer coating.

Polymeric coatings selected for use in the present invention provide sufficient: coating and adhesion properties to the core particle surface; triboelectric charging and conductivity; and abrasion and fibrillation characteristics, to achieve the aforementioned objectives. Suitable polymer resins include, for example, known fibrillatable polymers, such as those prepared from monomers such as vinylidene difluoride, hexafluoropropylene, vinyl carbazole, 4-vinyl pyridine, styrene, tetrafluoroethylene, butadiene, alkene monomers with from 2 to about 20 carbon atoms such as ethylene, vinyl chloride, vinyl acetate, acrylate esters, and the like, and mixtures thereof. Other suitable polymers include polyester resins obtained by, for example, condensation of diesters or diacids and diols.

In embodiments of the present invention, the process of forming fibrillated coated carriers by mechanical abrasion means can be improved and made more efficient by the addition of at least one plasticizer compound to the polymer resin coating mixture. Although not wanting to be limited by theory it is believed that the addition of the plasticizer compound to the resin coating alters the rheology of the resin coating so that the desired fibrils are formed more readily under constant abrasion conditions. Examples of suitable plasticizer compounds include phthalic anhydrides, substituted phthalic anhydride compounds, such as tetrachlorophthalic anhydride, polyvinyl chloride, cellulose ester compounds, adipate and sebacate esters, polyol compounds, tricresyl phosphate, and mixtures thereof, as well as other known plasticizer compounds.

Mechanical agitation can be provided by a variety of mixing devices which are capable of providing high shear force to the surface of the coated particles. The agitation provides an abrading shear stress of about 0.5 grams to about 1 kilogram. In embodiments, the agitation is accomplished at a temperature of from about 10° C. to about 150° C. Suitable particulate mixing devices include paint shakers, vibrating tubs, blenders, ball mills, hammer mills, mullers or mulls, screw conveyers, and sigma blade mixers, and similar devices. The agitation period required to achieve a suitably fibrillated coated carrier surface is from about 1 minute to about 60 minutes.

The carrier core particles preferrably have a density greater than the density of the toner resin particles selected for formulating a developer. and include, but are not limited to, iron, ferrites, steel, nickel, magnetites, glass, ceramic composites, plastic and mixtures thereof.

The resin coating on the surface of the carrier particles is from about 0.001 to about 3 weight percent. The carrier core has an average particle diameter of from about 25 microns to about 1,000 microns.

The amount of the aforementioned performance additives that can be added and used in the resin coating on the surface of the carrier particles is from about 0.05 to about 50 weight percent relative to the weight of the resin coating used. With respect to the optional fibrous particulate additive material, when selected, it is present in an amount of from about 0.5 to about 75 weight percent based on the total weight of the polymer coating.

In embodiments the polymer resin coating can be a mixture of two or more resin, and preferably comprised of a first polymer in an amount of from about 40 to about 60 percent by weight, and a second polymer in an amount of from about 60 to about 40 percent by weight.

In a preferred embodiment, the resin coating weight is 0.1 percent, the triboelectric charge on the carrier particles is about −63 microcoulombs per gram, the conductivity of the carrier particles is about $10^{-15}$ mho-cm$^{-1}$, and the carrier coating is a mixture of a polymer resin poly 4-vinylpyridine and a plasticizer tetrachlorophthalic anhydride in a weight ratio of about 3 to 1.

These and other objects of the present invention are provided by developer comprised of toner particles, and carrier particles prepared by a solution or powder coating process; and wherein the carrier particles comprise a core with a coating thereover comprised of at least one polymer resin and wherein the outer surface of the carrier coating is fibrillated. More specifically, the carrier particles selected can be prepared by mixing low density porous magnetic, or magnetically attractable metal core carrier particles with from, for example, between about 0.001 percent and about 3 percent by weight, based on the weight of the coated carrier particles, of a polymer or polymers until adherence thereof to the carrier core by, mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size. The fibrillated outer surface can be formed before, during or after the cooling and classification steps.

In embodiments of the present invention, there are provided carrier particles comprised of a carrier composition comprised of a core with a coating thereover comprised of a mixture of first and second polymers that are not in close proximity thereto in the triboelectric series. The carrier compositions can be comprised of known core materials including iron with a polymer coating mixture thereover. Subsequently, developer compositions of the present invention can be generated by admixing the aforementioned carrier particles with a toner composition comprised of resin particles and pigment particles.

Various suitable solid core carrier materials can be selected providing the objectives of the present invention are obtained. Characteristic core properties of importance include those that will enable the toner particles to acquire a positive charge or a negative charge; and carrier cores that will permit the coated carrier in combination with toner particles to achieve either positive or negative triboelectric charging values, for example, from about 5 to about 80 microcoulombs per gram, and desirable flow properties in the developer reservoir when present in a xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics.

Illustrative examples of mixed polymer coatings selected for coating the carrier particles of the present invention include those that are not in close proximity in the triboelectric series. Specific examples of polymer mixtures used are polyvinylidenefluoride with polyethylene; polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride. Other related polymer mixtures not specifically mentioned herein can be selected providing the objectives of the present invention are achieved, including for example, polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polyethylene, has a triboelectric charging value of about −17 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "*Electric Properties of Polymers*", Seanor, D. A., Chapter 17, *Polymer Science*, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures used contains from about 10 to about 90 percent of the first polymer, and from about 90 to about 10 percent by weight of the second polymer. Preferably, there are selected mixtures of polymers with from about 40 to 60 percent by weight of the first polymer, and from about 60 to 40 percent by weight of a second polymer. In one embodiment of the present invention, when a high triboelectric charging value is desired, that is, exceeding −50 microcoulombs per gram, there is selected from about 90 percent by weight of the first polymer such as polyvinylidenefluoride; and 10 percent by weight of the second polymer such as polyethylene. In contrast, when a lower triboelectric charging value is required, less than about −20 microcoulombs per gram, there is selected from about 10 percent by weight of the first polymer; and 90 percent by weight of the second polymer.

Also, these results, in accordance with a preferred embodiment of the present invention, carrier particles of relatively constant conductivities from between about $10^{-15}$ mho-cm$^{-1}$ to from about $10^{-9}$ mho-cm$^{-1}$ at, for example, a 10 volt impact across a 0.1 inch gap containing carrier beads held in place by a magnet; and wherein the carrier particles are of a triboelectric charging value of from −10 microcoulombs per gram to −75 microcoulombs per gram, these parameters being dependent on the coatings selected, and the percentage of each of the polymers used as indicated hereinbefore.

Various effective suitable means can be used to apply the polymer mixture coatings to the surface of the carrier particles. Examples of typical means for this purpose include combining the carrier core material, and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-cm$^{-1}$ as measured, for example, across a 0.1 inch magnetic brush at an applied potential of 10 volts; and wherein the coating coverage encompasses from about 0.1 percent to about 100 percent of the carrier core surface.

Illustrative examples of finely divided toner resins selected for the developer compositions of the present invention include polyamides, epoxies, polyurethanes, diolefins, vinyl resins and polymeric esterification products of a dicarboxylic acid and a diol including diphenols. Specific vinyl monomers that can be used are styrene, p-chlorostyrene, vinyl naphthalene, unsaturated monoolefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters with from 4 to about 20 carbon atoms such as the esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidine; styrene butadiene copolymers; mixtures thereof; and other similar substances.

As one preferred toner resin there can be selected the esterification products of a dicarboxylic acid and a diol comprising a diphenol, reference U.S. Pat. No. 3,590,000 the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyan materials that may be used as pigments include copper tetra-4 (octadecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition an amount of from about 1 weight percent to about 15 weight percent based on the weight of the toner resin particles.

For further enhancing the positive charging characteristics of the developer compositions described herein, and as optional components there can be incorporated herein charge enhancing additives inclusive of alkyl pyridinium halides, reference, respectively, U.S. Pat. Nos. 4,298,672; organic sulfate or sulfonate compositions, 4,338,390; distearyl dimethyl ammonium sulfate 4,291,112; and 4,904,762, entitled Toner Compositions with Charge Enhancing Additives, the disclosures of which are totally incorporated herein by reference; and other similar known charge enhancing additives. These additives are usually incorporated into the toner bulk or onto the toner surface in an amount of from about 0.1 percent by weight to about 20 percent by weight.

The toner composition of the present invention can be prepared by a number of known methods including melt blending the toner resin particles, and pigment particles or colorants of the present invention followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired toner product. In embodiments, a preferred toner particle size as measured in volume average diameter, is in the range from about 1 to about 20 microns, and more preferrably, from about 2 to about 8 microns, especially, for example, for use in high print quality color applications.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner. Other photoresponsive devices useful in the present invention include polyvinylcarbazole 4-dimethylaminobenzylidene, benzhydrazide; 2-benzylidene-amino-carbazole, 4-dimethamino-benzylidene, (2-nitro-benzylidene)-p-bromoaniline; 2,4-diphenyl-quinazoline; 1,2,4-triazine; 1,5-diphenyl-3-methyl pyrazoline 2- (4'-dimethylaminophenyl)-benzoxazole; 3-aminocarbazole, polyvinyl carbazole-trinitrofluorenone charge transfer complex; and mixtures thereof. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution, with acceptable or substantially no background deposits.

With further reference to the process for generating the carrier particles illustrated herein, there is initially obtained, usually from commercial sources, the uncoated carrier core and the polymer powder mixture coating. The individual components for the coating are available, for example, from Elf Atochem North America, Inc., as 301F KYNAR, as Polymist B6 , from Allied Chemical, and other sources. Generally, these polymers can be blended in various proportions as mentioned hereinbefore as illustrated herein as, for example, in ratios of 0.5:0.5, 0.1:0.90, 0.6:0.4 and various intermediate ratios. The blending can be accomplished by numerous known methods including, for example, a V-cone mixing apparatus. Thereafter, the carrier core polymer blend is incorporated into a mixing apparatus, about 1 percent by weight of the powder to the core by weight in a preferred embodiment and further mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend to the carrier core.

In an illustrative embodiment, there is provided a process for preparing a coated carrier composition comprising: providing a polymer resin coated carrier composition; and agitating the polymer resin coated carrier particles with highly abrading shear force, and wherein the resulting outer surface of the coated carrier is fibrillated.

In other embodiments, there is provided a process for preparing a coated carrier composition comprising: coating carrier core particles with a solution of at least one polymer resin, a plasticizer compound, and a solvent or solvent mixture; evaporating the solvent; and agitating the resulting polymer coated carrier particles with high shear, and wherein the resulting outer surface of the coated carrier is fibrillated.

The carrier compositions of the present invention are, in embodiments, useful in, for example, fine particle sized color toners and marking processes comprising, for example, toner particle sizes on the order of from about 2 to about 8 microns.

The preparative coating processes of the present invention, in embodiments, can be accomplished in accordance with the aforementioned commonly owned and assigned U.S. Pat. No. 4,937,166.

In embodiments of the present invention, the coated carrier compositions may be prepared by conventional mechanical, chemical and physical means known to one of ordinary skill in the art and upon comprehending the present invention.

Other materials that may be used in conjunction with the fibrillated coatings and preparative processes thereof are synthetic fibers, metallized synthetic fibers, and metallic fibers, flakes, whiskers, and the like, wherein the materials may be either magnetic or non-magnetic.

The fibrillated carrier coatings and processes of making and using the present invention enable developers with greater toner concentration and latitude by increasing tribo charging surface area while reducing toner dust and dirt generation.

The carrier coatings may be applied to any core material such as steel, nickel, ferrite, glass, ceramic and the like materials, to produce useful tribo charging properties when combined with suitable black and colored toners. The carrier coatings produced may also be combined with other suitable powdered resins to yield positive or negative charging marking materials as desired. Solvents may also be employed to adhere the coating materials.

The developers obtained from combining the carrier with suitable toners may be used in, for example, xerographic, ionographic or other imaging process for single pass color, multiple pass color, at one or more potential level, for example, the known tri-level xerographic processes, for light lens or digital copiers and printing machines.

The following examples are illustrative of the invention embodied herein. All amounts are by weight percent unless specified otherwise.

EXAMPLE I

Carrier Coating

TEFLON K Type 10 (dry powder) and Type 20 (dispersion grade) both composed of polytetrafluoroethylene resin, available from E.I. DuPont, were each used to coat atomized oxidized Hoeganaes 80/150 mesh grit core. Type 10 powder was powder coated onto 2,268 grams of the core using a paint shaker to disperse 2.3 grams of the resin powder on the core surface to produce about a 0.1 weight percent coating. The violent agitation of the paint shaker after about 30 minutes was sufficient to heat up the mixture and cause the resin to fibrillate into a random network of fibers. About 7.7 grams of Type 20 dispersion at about 30 weight percent solids was mechanically distributed for about 10 minutes over 2,268 grams of the core, using a paint shaker. The mixture was placed in a pan and was heated to about 250° F. to drive off water from the dispersion, and then the mixture placed in a container and agitated on a paint shaker for about 10 minutes while hot to initiate fibrillation of the coating. Additional agitation for up to about 1 hour did not appear to change or increase the apparent fibrillation properties.

EXAMPLE II

Carrier Coating

KYNAR 7201, a copolymer of vinylidene fluoride and tetrafluoroethylene, available from Elf Atochem, was used to coat 100/200 mesh spherical Nuclear Metals Corporation core. KYNAR 7201 dissolved in methyl ethyl ketone (MEK) at 8%, 15%, and 20% solids, was applied to the core using a VIBRATUB mixer. The core was preheated to 85° C. Fibrillation of the KYNAR 7201 occurred as the solvent evaporated from the mixture vibrating in the mixing tub.

Table 1 lists exemplary coated carriers prepared and some of the properties measured for the resultant fibrillated carrier.

Photomicrographs were obtained for some of the carrier coatings prepared and of several developers comprised of fibrillated carrier particles in admixture with toner particles. In the developers, toner particles are seen clinging to a fibrous network of the fibrillated carrier surface coating as well as the unfibrillated coated core surface thereby demonstrating the increased tribo charging surface available.

Roll mill tribo charging values were generally quite high for the fibrillated carriers. Very little free toner was deposited on the inside wall of the glass jars used for tribo measurements indicating good toner adhesion to the fibrillated carrier coating.

Toner dusting in these developers was substantially reduced for all of the fibrillated coated carriers compared to conventional developers by observing the toner cloud produced when the developers were dumped from one glass jar to another.

EXAMPLE III

Carrier Coating

Polyvinyl carbazole (PVK) and poly 4-vinyl pyridine (PVPy) polymers both readily fibrillated in combination with solvent and tetrachlorophthalic anhydride (TCPA) plasticizer when coated onto core particles. It is believed that the TCPA is plasticizing the resin as the solvent evaporates causing an increase in the extent of fibrillation of the resin coating compared to resin coatings without the TCPA present. Triboelectric charge measurements are shown in Table 2 and indicate that the fibrillated coating have higher tribocharge values than the control coating, for example, comprising 100 percent resin without plasticizer added.

The solvent system used to coat PVK carriers was a 1:1 by weight mixture of toluene and tetrahydrofuran. PVPy coating were applied from a 4:1 by weight solvent mixture of chloroform and methanol.

EXAMPLE IV

Carrier Coating

A fibrillated carrier was also produced by adding acicular and fibrous materials to the carrier coating. The coatings were prepared by adding the fibrous materials to the carrier polymer comprised of a terpolymer of styrene, methacrylate and a silane compound as described in the aforementioned U.S. Pat. No. 3,590,000 and using the VIBRATUB mixer and coating process. The various fibrous additive materials used to produce these coatings are listed in Table 3.

TABLE 1

Fibrillated Carrier coatings

| Attribute | Carrier Coating # 1 | 2 | 3 | 4 | 5 | 6 | 7 |
|---|---|---|---|---|---|---|---|
| % Teflon K-T10 | | | | 0.1 | 0.001 | 0.1 | 1.0 |
| % Teflon K-T20 | | | | | | | |
| % Kynar 7201 | 0.2 | 0.4 | 0.6 | | | | |
| Core[2] | A | A | A | B | B | B | B |
| Coating Process[3] | C | C | C | D | D | D | D |
| Tribo μc/g (T.C. %)[1] | | | | | | | |
| 10 minutes | −52 (0.8) | −51 (0.8) | −57 (0.8) | −24 (3.0) | — | −37 (2.8) | −28 (2.9) |
| 60 minutes | −47 (0.9) | −51 (0.8) | −39 (0.9) | −21 (3.1) | — | −35 (2.8) | −31 (2.8) |
| 300 minutes | −35 (0.9) | −42 (1.0) | −51 (1.0) | −18 (2.9) | — | −30 (2.5) | −35 (3.0) |
| 24 hours | −19 (1.0) | −32 (0.9) | −38 (0.9) | −16 (3.0) | — | −28 (2.7) | −43 (2.7) |
| Apparent Density (g/cm$^3$) | | | | 3.23 | 3.3 | 3.29 | |
| Mass flow (g/sec.) | | | | 1.71 | 1.92 | 1.88 | |
| Vol. flow (cm$^3$/sec.) | | | | 0.529 | 0.582 | 0.571 | |
| BET (cm$^2$/g) | 70 | 83 | 79 | | | | |
| Breakdown Voltage (Dynamic Gutman Cell Carrier) | 112 | 226 | 169 | | | 75 | 175 |
| Conductivity (1/ohm cm) Static Gutman Cell Carrier | $1.6 \times 10^{-12}$ | | $<10^{-13}$ | | | $8.5 \times 10^{-10}$ | $3.7 \times 10^{-13}$ |

[1]Toner = 92% styrene-butylacrylate resin, 6% REGAL 330 carbon black, 2% quaternary ammonium salt charge additive cetyl pyridinuim chloride.
[2]Core: A = 100/200 mesh Nuclear Metals.; B = Oxidized Hoeganaes Grit.
[3]Coating Process: C = VIBRATUB-solution coating; and D = Paint Shaker.

TABLE 2

Tribocharge of Developers with 0.4 Weight Percent Resin/TCPA Plasticizer Carrier Coatings

| Carrier # | Resin | Resin to TCPA Ratio | Tribo ▮ c/g (T.C. %) 10 minutes | 60 minutes | 300 minutes |
|---|---|---|---|---|---|
| 8 | PVK | — | −15.8 (0.8) | −7.3 (0.5) | +0.9 (1.5) |
| 9 | PVK | 5/1 | −25.0 (0.9) | −16.6 (0.9) | −12.0 (1.0) |
| 10 | PVK | 5/3 | −19.6 (1.0) | −14.8 (0.9) | −13.7 (0.8) |
| 11 | PVK | 5/2 | −21.1 (0.9) | −16.6 (0.8) | −12.2 (0.8) |
| 12 | PVPy | — | −18.9 (1.1) | −14.2 (1.0) | −11.4 (0.8) |
| 13 | PVPy | 3/1 | −32.7 (0.9) | −19.4 (1.0) | −17.7 (0.8) |
| 14 | PVPy | 3/2 | −25.9 (1.0) | −20.6 (0.6) | −17.3 (0.9) |

TCPA = Tetrachlorophthalic Anhydride
PVK = Polyvinyl Carbazole
PVPy = Poly(4-Vinyl Pyridine)
Toner = 92% styrene-butylacrylate resin, 6% REGAL 330 Carbon Black, 2% quaaternary ammonium salt charge additive cetyl pyridinuim chloride
Core = 100/200 mesh Nuclear Metals
1)T.C. % = toner concentration as a weight percent of developer.

TABLE 3

Flocked Carrier Coating

| Fiber Material | Fiber Length (microns) | WT. % fiber in coating | Tribo ▮ c/g (T.C. %) 10 minutes | 60 minutes | 300 minutes |
|---|---|---|---|---|---|
| — | None | 0 | 26.1 (.9) | 27.0 (0.8) | 22.5 (1.0) |
| ASTROQUARTZ (Quartz) | 1 → 400 | 13.0 | 11.4 (1.2) | 16.4 (1.4) | 21.5 (1.0) |
| FYBREL polyethylene | ~700 | 2.0 | 13.5 (13.2) | 20.3 (1.0) | 15.1 (1.0 |
| thornel carbon | 1 → 300 | 19.0 | 14.6 (1.2) | 19.7 (1.1) | 14.7 (1.1) |
| cotton | ~⅛" | 50.0 | 15.1 (1.1) | 20.3 (1.0) | 17.5 (1.2) |
| wollastonite | — | — | 17.7 (1.1) | 19.1 (1.1) | 16.3 (0.9) |
| quaternized cellulose | → 30 | 22.0 | 18.6 (1.0 | 20.4 (0.8) | 23.6 (0.9) |
| acidified cellulose | 10 → 50 | 22.0 | 21.5 (1.0) | 25.0 | 23.0 |
| cellulose | 50 → 60 | 50.0 | 15.8 (1.0) | 26.2 (0.9) | 25.0 (0.8) |

TABLE 3-continued

| Flocked Carrier Coating | | | | | |
|---|---|---|---|---|---|
| | Fiber | WT. % | Tribo ▮ c/g (T.C. %) | | |
| Fiber Material | Length (microns) | fiber in coating | 10 minutes | 60 minutes | 300 minutes |
| microcrystalline cellulose | 50 | 22.0 | 16.1 (1.0) | 24.1 (0.9) | 19.0 (1.1) |

Toner = 92% styrene-butylacrylate resin, 6% REGAL 330 Carbon Black, 2% quaaternary ammonium salt charge additive cetyl pyridinuim chloride
Coating = terpolymer of styrene, methacrylate and a silane at 0.4 weight percent on 100/200 Nuclear Metals core The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

What is claimed is:

1. A coated carrier for use in electrostatographic imaging processes comprised of core particles comprised of a material selected from iron, ferrites, steel, nickel, magnetites, glass, ceramic composite, plastic, or mixtures thereof, with a coating thereover comprised of at least one polymer resin, wherein the outer surface of the coated carrier is fibrillated, and wherein the fibrillated outer surface is comprised of fibrils of said at least one polymeric resin.

2. A carrier according to claim 1 wherein the fibrillated outer surface of the polymer coated carrier has a fiber surface area coverage of about 1 fiber per 10 square microns to about 9,000 fibers per 10 square microns.

3. A carrier according to claim 1 wherein the fibrillated outer surface of the polymer coated carrier is comprised of fibers with an average diameter of about 0.01 microns to about 25 microns, and an average length of about 1 micron to about 3,125 microns.

4. A carrier according to claim 1 wherein the polymer resin is a homopolymer, copolymer, block or graft polymer prepared from free radical polymerizable monomers selected from the group consisting of vinylidene difluoride, hexafluoropropylene, vinyl carbazole, 4-vinyl pyridine, styrene, tetrafluoroethylene, butadiene, alkene monomers with from 2 to about 20 carbon atoms, vinyl chloride, vinyl acetate, acrylate esters, and mixtures thereof.

5. A carrier according to claim 1 further comprising a plasticizer compound in admixture with the polymer resin or resins.

6. A carrier according to claim 5 wherein the plasticizer compound is tetrachlorophthalic anhydride.

7. A coated carrier according to claim 5 wherein the resin coating weight is 0.1 percent by weight based on the weight of the uncoated carrier particles, the triboelectric charge on the carrier particles is about −63 microcoulombs per gram, the conductivity of the coated carrier particles is about $10^{-15}$ mho-cm$^{-1}$, and the carrier coating is a mixture of a polymer resin, poly 4-vinylpyridine, and a phthalic anhydride plasticizer in a weight ratio of about 3 to 1.

8. A carrier according to claim 1 wherein the coated carrier in combination with toner particles provides a developer which has a positive or negative triboelectric charging value from about 5 to about 80 microcoulombs per gram.

9. A developer comprising coated carrier particles according to claim 1 and toner particles, wherein the conductivity of the developer resides in a range of from about $10^{-6}$ mho-cm$^{-1}$ to about $10^{-17}$ mho-cm$^{1-}$.

10. A carrier according to claim 1 wherein the core has an average particle diameter of from about 25 microns to about 1,000 microns.

11. A coated carrier according to claim 1 wherein the resin coating weight is from about 0.001 to about 3 weight percent with respect to the total weight of the uncoated carrier.

12. A coated carrier of claim 1 wherein the triboelectric charge of the coated carrier is from about a −10 to about a −75 microcoulombs per gram.

13. A coated carrier according to claim 1 wherein the polymer resin coating further comprises fibrous particulate material selected from the group consisting of fibrillated polytetrafluoroethylene, fibrillated aramid or polyaramid, polymers and copolymers of alkene monomers with from 2 to about 20 carbon atoms, carbon, cellulose, quaternized cellulose, acidified cellulose, microcrystalline cellulose, cotton, clay, fibrillated minerals, metal fibers, metal flakes, metal whiskers, surface metalized fibers, and mixtures thereof.

14. A carrier according to claim 13 wherein the fibrous particulate material has an average diameter of about 0.01 microns to about 25 microns, and an average length of about 1 micron to about 3,125 microns.

15. A coated carrier according to claim 13 wherein the fibrous particulate material is present in an amount of from about 0.5 to about 75 weight percent based on the total weight of the polymer coating.

16. A carrier according to claim 1 wherein the polymer resin is a polyester.

17. A developer composition comprising the coated carrier particles of claim 1 and toner particles wherein the toner particle size is from about 2 to about 8 microns in volume average diameter.

18. A process for preparing a coated carrier composition comprising:

providing polymer resin coated carrier particles; and agitating the polymer resin coated carrier particles with a highly abrading shear stress force of from about 0.5 grams to about 1 kilogram until the resulting outer surface of the coated carrier particles are fibrillated.

19. A process according to claim 18 wherein the agitation is achieved using, as a particulate mixing device, a paint shaker, vibrating tub mixer, blender, ball mill, hammer mill, a mull, a screw conveyor, or a sigma blade mixer.

20. A process according to claim 18 wherein the agitation is for a period of about 1 minute to about 60 minutes.

21. A process according to claim 18 wherein the agitation is accomplished at a temperature of from about 10° C. to about 150° C.

22. A process for preparing a coated carrier composition comprising:

coating carrier core particles with a solution of at least one polymer resin, a plasticizer compound; and a solvent or solvent mixture;

evaporating the solvent; and agitating the resulting polymer coated carrier particles with high shear of from about 0.5 grams to about 1 kilograms, until the resulting outer surface of the coated carrier is fibrillated.

23. A process according to claim 22 wherein the agitation of the resulting polymer coated carrier particles is accomplished simultaneously with the evaporation of the solvent.

24. A process for preparing a coated carrier composition comprising:

coating carrier core particles with a mixture of at least one polymer resin, and fibrous particulate additive, and optionally a plasticizer compound; and agitating the resulting coated carrier particles with high shear of from about 0.5 grams to about 1 kilograms, and wherein the resulting outer surface of the coated carrier particles are fibrillated.

* * * * *